US007300290B2

(12) United States Patent
Yamagami et al.

(10) Patent No.: US 7,300,290 B2
(45) Date of Patent: Nov. 27, 2007

(54) ELECTRICAL CONNECTOR

(75) Inventors: Hidehisa Yamagami, Kanagawa (JP); Yusuke Mito, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/278,971

(22) Filed: Apr. 7, 2006

(65) Prior Publication Data

US 2006/0234529 A1 Oct. 19, 2006

(30) Foreign Application Priority Data

Apr. 15, 2005 (JP) ..... 2005-117785

(51) Int. Cl.
*H01R 12/00* (2006.01)

(52) U.S. Cl. ..... 439/79; 439/569

(58) Field of Classification Search ..... 439/78–79, 439/83, 569

See application file for complete search history.

(56) References Cited

U.S. PATENT DOCUMENTS 5,316,489 A * 5/1994 Kachlic et al. ..... 439/79
5,472,358 A 12/1995 Tan et al.
5,827,077 A * 10/1998 Fukuda ..... 439/79
6,505,402 B2 * 1/2003 Moriwake et al. ..... 29/883
2004/0242071 A1 12/2004 Ito et al.

FOREIGN PATENT DOCUMENTS

JP 06-333652 12/1994

OTHER PUBLICATIONS

European Search Report dated Jul. 13, 2006 for application No. EP 06 11 2615.

* cited by examiner

*Primary Examiner*—Truc Nguyen
(74) *Attorney, Agent, or Firm*—Barley Snyder LLC

(57) ABSTRACT

An electrical connector comprises an insulating housing and first contacts secured to the housing. Each of the first contacts has the same shape and includes a housing securing member, a contact member extending from a first end of the housing securing member, and a circuit board connecting member extending from a second end of the housing securing member that is offset from the contact member. The first contacts are arranged such that adjacent circuit board connecting members of the first contacts are arranged at substantially the same pitch. A plurality of the first contacts is inverted by substantially 180 degrees, and the contact members of the first contacts inverted by substantially 180 degrees and adjacent contact members of the first contacts not inverted by substantially 180 degrees are arranged at a pitch different from the pitch of the circuit board connecting members.

19 Claims, 6 Drawing Sheets

ELECTRICAL CONNECTOR

FIELD OF THE INVENTION

The invention relates to an electrical connector having a pitch conversion.

BACKGROUND OF THE INVENTION

An electrical connector having a pitch conversion can be used in cases where a plurality of electronic components are connected to each other, electronic components are connected to a circuit board, circuit boards are connected to each other, or a mating connector having contacts that are connected to a plurality of electrical wires and a circuit board are connected to each other.

FIG. 8 shows an example of a conventional electrical connector 101 (see JP 6-333652A) that is used when a plurality of electronic components are connected to each other. As shown in FIG. 8, the electrical connector 101 includes a wiring board 102. An insulating frame 103 is provided around the wiring board 102. A plurality of first contacts 104 are provided side by side at a specified pitch on a portion of the insulating frame 103 corresponding to a first side of the wiring board 102. A plurality of second contacts 105 are provided side by side at a pitch that is smaller than the specified pitch described above on a portion of the insulating frame 103 corresponding to a side opposite from the first side of the wiring board 102.

A plurality of conductor lines 110 connect the first contacts 104 with the second contacts 105 and are formed on the wiring board 102. External terminals 107 of a first electronic component 106 are inserted into the first contacts 104, and external terminals 109 of a second electronic component 108 are inserted into the second contacts 105 to connect the first and second electronic components 106, 108 via the electrical connector 101.

The electrical connector 101 can be applied to a wide variety of electronic components by varying the pattern of the conductor lines 110 formed on the wiring board 102 and varying the pitch of the first and second contacts 104, 105. Therefore, there is no need to manufacture multiple contact molds according to pitch conversion modes. Thus, the cost of manufacturing the electrical connector 101 can be reduced. However, in the electrical connector 101, it is necessary to provide the wiring board 102 for the purpose of pitch conversion, which adds to the cost of the electrical connector 101. Furthermore, in addition to having to attach the first and second contacts 104, 105 to the insulating frame 103, the wiring board 102 must also be mounted within the insulating frame 103. As a result, the electrical connector 101 is difficult to assemble.

FIG. 7 shows another example of a conventional electrical connector 201 (see JP 6-333652A) that has a pitch conversion. As shown in FIG. 7, the electrical connector 201 includes a plurality of first through fifth contacts 203*a*, 203*b*, 203*c*, 203*d*, 203*e* having a large variety of shapes. The first through fifth contacts 203*a*, 203*b*, 203*c*, 203*d*, 203*e* are press-fitted to an insulating housing 202. A first electronic component 204 has external terminals 205 extending therefrom. A second electronic component 206 has external terminals 207 extending therefrom In the electrical connector 201, the first through fifth contacts 203*a*, 203*b*, 203*c*, 203*d*, 203*e* each have a different shape. Therefore, in order to perform pitch conversion, different molds need to be manufactured depending upon the number of the external terminals 205, 207. Moreover, when the first through fifth contacts 203*a*, 203*b*, 203*c*, 203*d*, 203*e* are press-fitted to the housing 202, the first through fifth contacts 203*a*, 203*b*, 203*c*, 203*d*, 203*e* need to be press-fitted from a side of the first electronic component 204 or from the opposite side thereof. However, the amount of offset in each of the first through fifth contacts 203*a*, 203*b*, 203*c*, 203*d*, 203*e* is different. The amount of bending generated in each of the first through fifth contacts 203*a*, 203*b*, 203*c*, 203*d*, 203*e* during press-fitting therefore is different, which causes problems during press-fitting to the housing 202.

BRIEF SUMMARY OF THE INVENTION

It is therefore an object of the invention to provide an electrical connector having a pitch conversion in which the cost of the electrical connector is low and the electrical connector can be easily assembled.

This and other objects are achieved by an electrical connector comprising an insulating housing and first contacts secured to the housing. Each of the first contacts has the same shape and includes a housing securing member, a contact member extending from a first end of the housing securing member, and a circuit board connecting member extending from a second end of the housing securing member that is offset from the contact member. The first contacts are arranged such that adjacent circuit board connecting members of the first contacts are arranged at substantially the same pitch. A plurality of the first contacts is inverted by substantially 180 degrees, and the contact members of the first contacts inverted by substantially 180 degrees and adjacent contact members of the first contacts not inverted by substantially 180 degrees are arranged at a pitch different from the pitch of the circuit board connecting members.

DETAILED DESCRIPTION OF THE INVENTION

Figure 1:
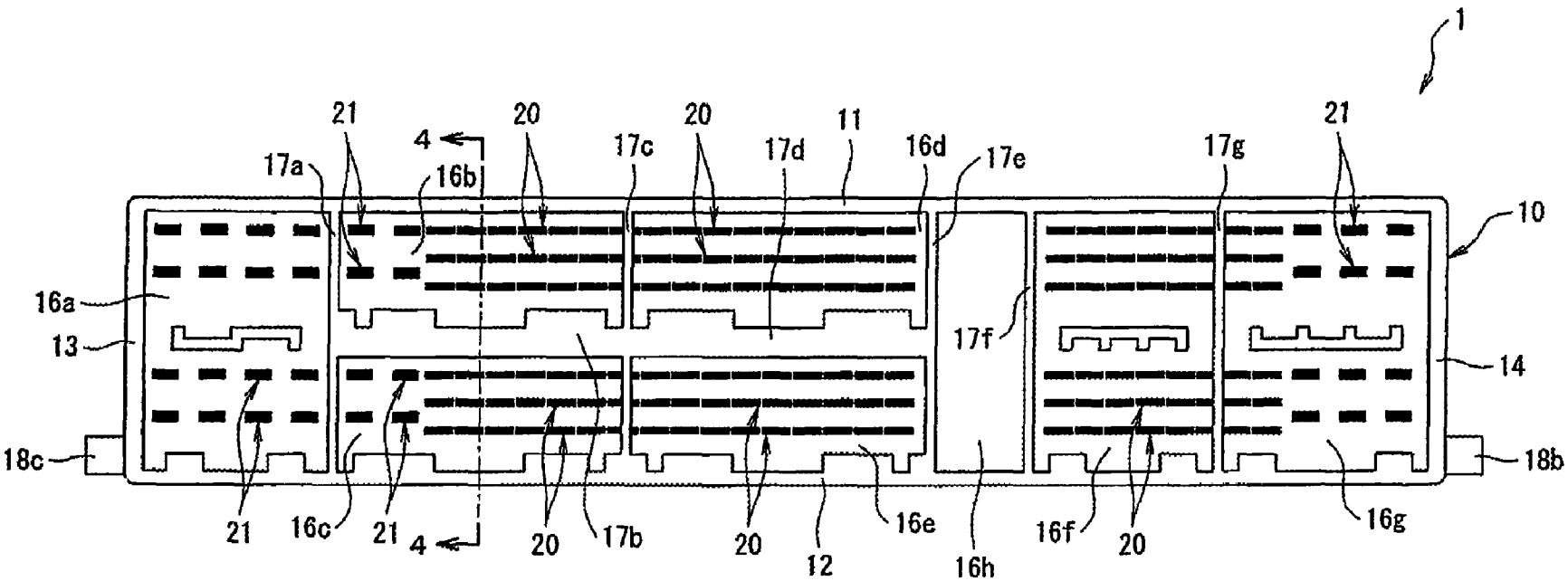
FIG. 1 is a front view of an electrical connector according to the invention.

FIG. 1 shows an electrical connector 1. The electrical connector 1 comprises an insulating housing 10. The housing 10 may be formed, for example, from molding an insulating resin. The housing 10 has a substantially rectangular shape and includes a top wall 11, bottom wall 12, first side wall 13, second side wall 14, and rear wall 15. A plurality of first through seventh connector receiving recesses 16*a*, 16*b*, 16*c*, 16*d*, 16*e*, 16*f*, 16*g*, respectively, are formed in the housing 10.

The first connector receiving recess 16*a* extends from the first side wall 13 to a first partition wall 17*a* that extends between the top wall 11 and the bottom wall 12. The second and third connector receiving recesses 16*b*, 16*c* extend between the first partition wall 17*a* and a third partition wall 17*c* that extends between the top wall 11 and the bottom wall 12. A second partition wall 17*b* extends between the first and third partition walls 17*a*, 17*c* between the second and third connector receiving recesses 16*b*, 16*c*. The second connector receiving recess 16*b* is arranged above the second partition wall 17*b*, and the third connector receiving recess 16*c* is arranged beneath the second partition wall 17*b*. The fourth and fifth connector receiving recesses 16*d*, 16*e* extend between the third partition walls 17*c* and a fifth partition wall 17*e* that extends between the top wall 11 and the bottom wall 12. A fourth partition wall 17*d* extends between the third and fifth partition walls 17*c*, 17*e* between the fourth and fifth connector receiving recesses 16*d*, 16*e*. The fourth connector receiving recess 16*d* is arranged above the fourth partition wall 17*d*, and the fifth connector receiving recess 16*e* is arranged beneath the fourth partition wall 17*d*. An empty recess 16*h* extends between the fifth partition wall 17*e* and a sixth partition wall 17*f* that extends between the top wall 11 and the bottom wall 12. The sixth connector receiving recess 16*f* extends between the sixth partition wall 17*f* and a seventh partition wall 17*g* that extends between the top wall 11 and the bottom wall 12. The seventh connector receiving recess 16*g* extends between the seventh partition wall 17*g* and the second side wall 14.

Figure 2:
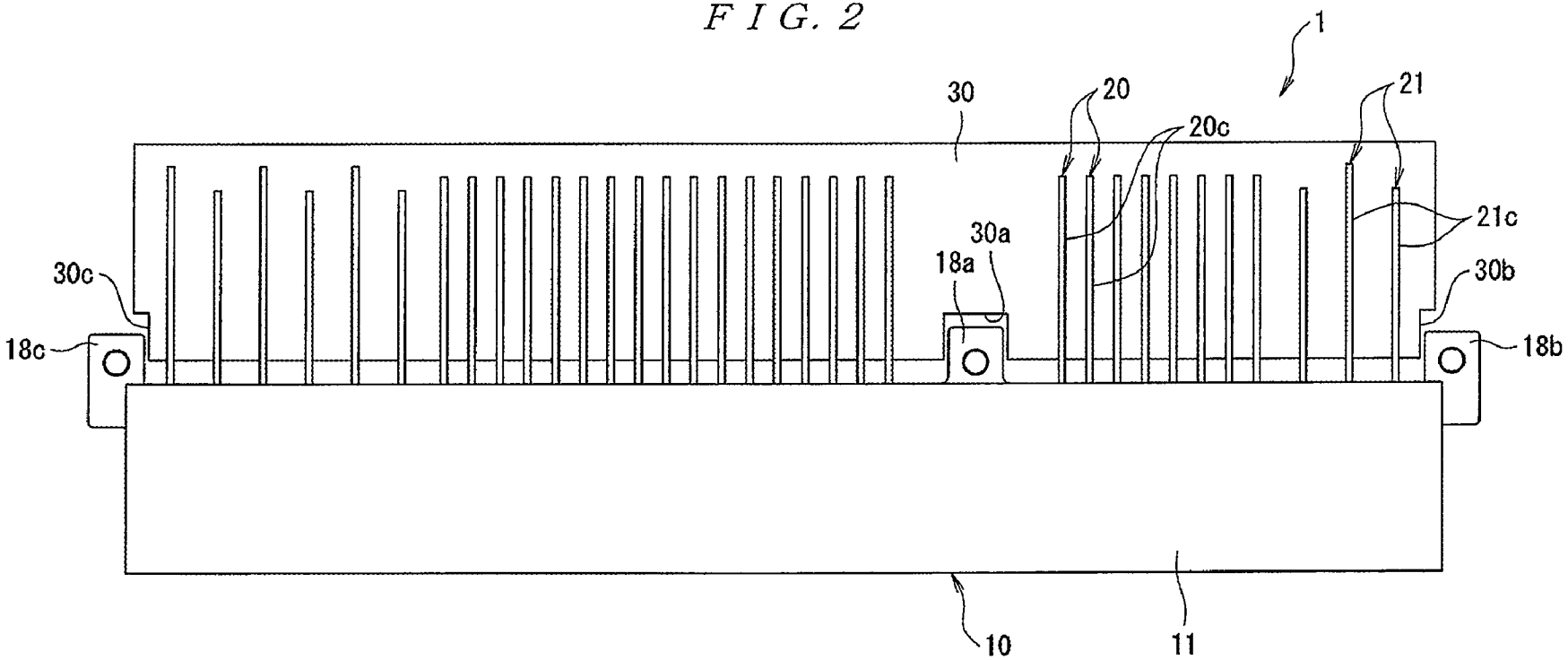
FIG. 2 is a plan view of the electrical connector.
Figure 3:
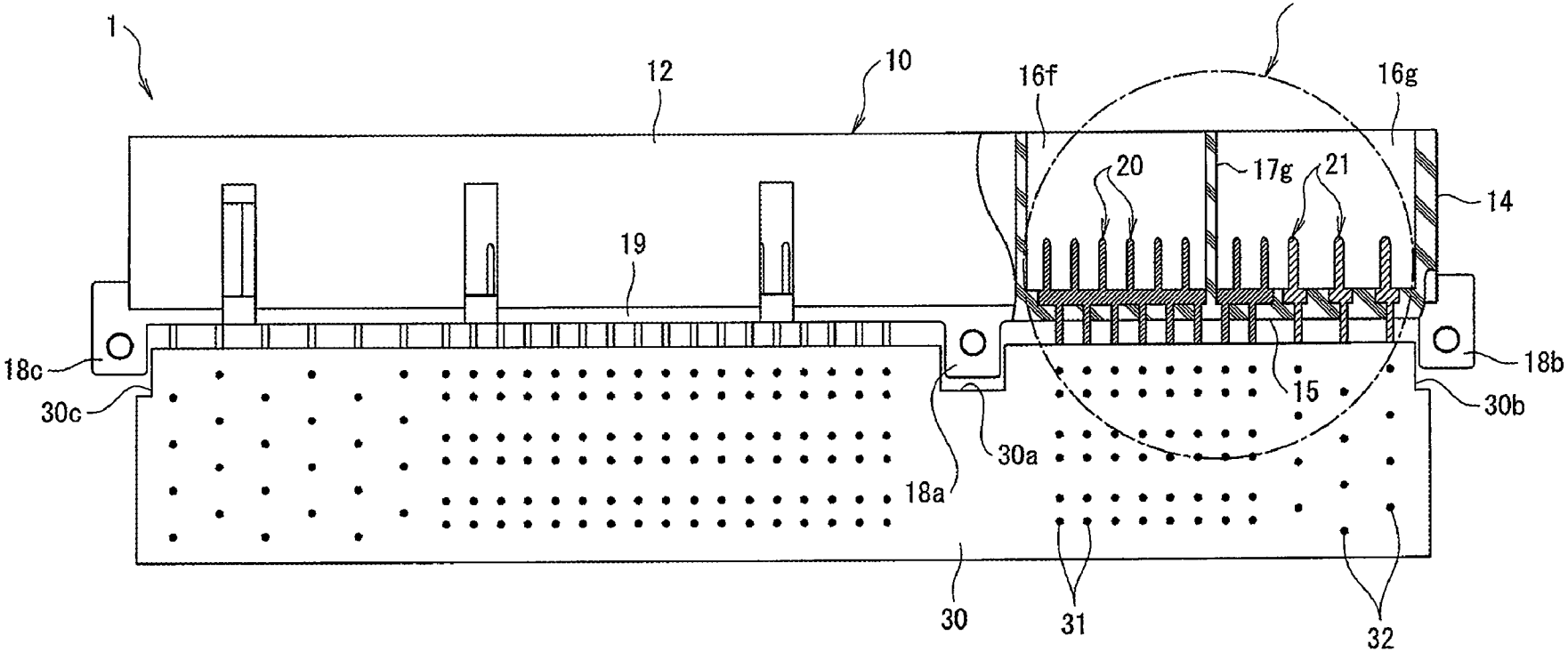
FIG. 3 is a partial cross-sectional bottom view of the electrical connector.
Figure 6:
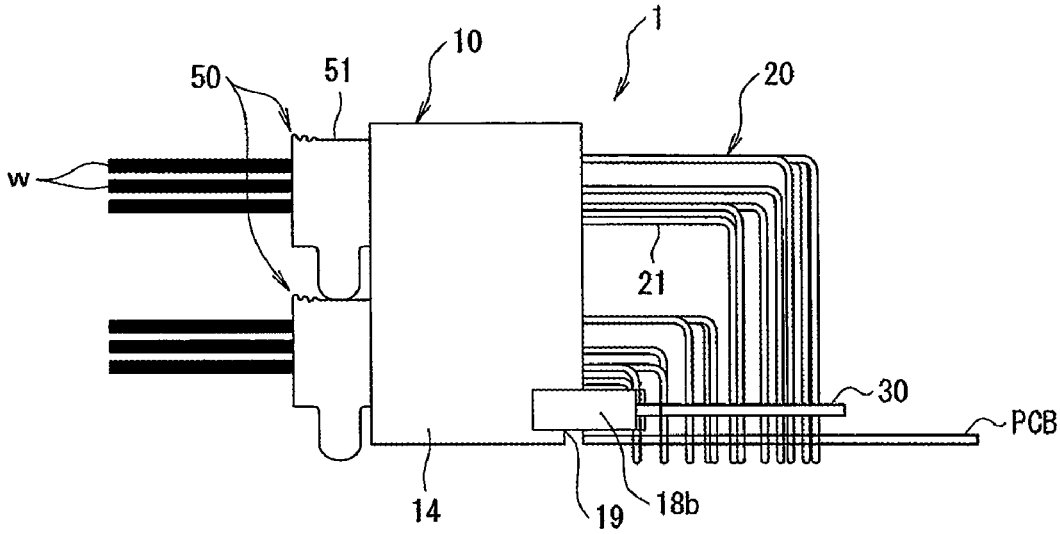
FIG. 6 is a side view showing the electrical connector mated with mating connectors.
Figure 7:
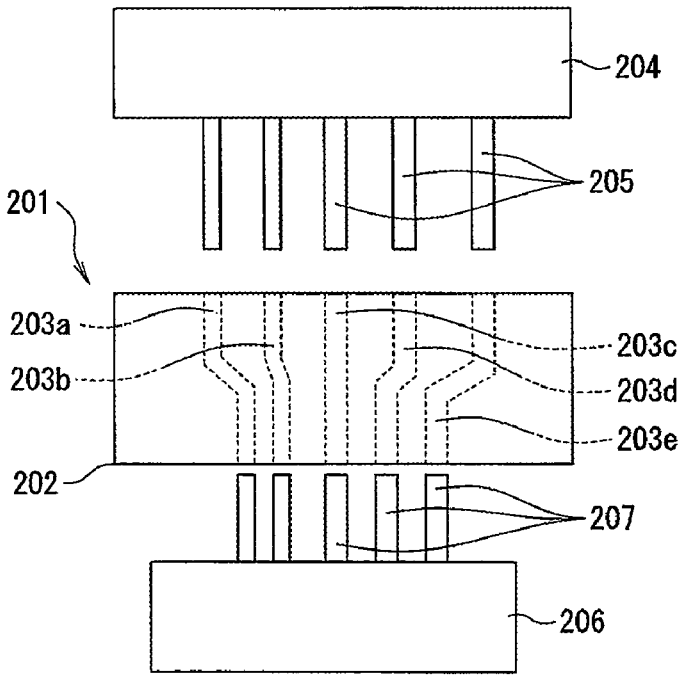
PRIOR ART FIG. 7
FIG. 7 is a plan view of an electrical connector of the prior art.
Figure 8:
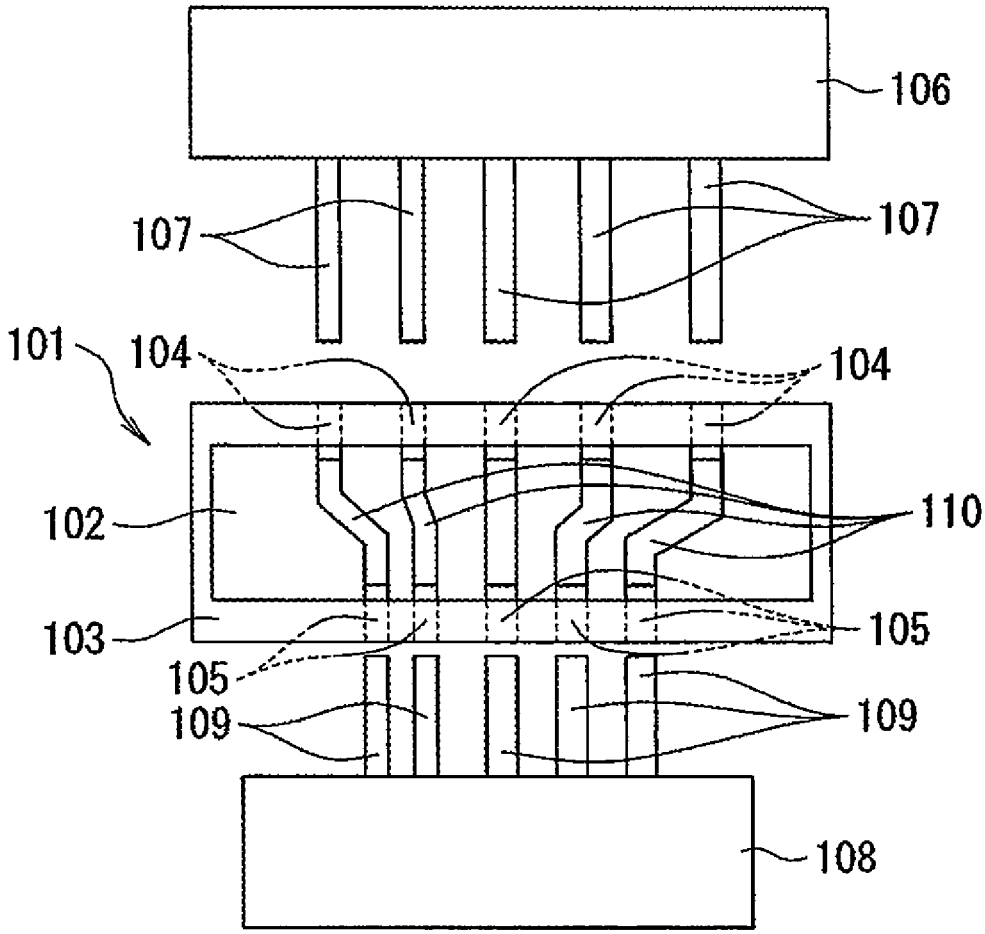
PRIOR ART FIG. 8
FIG. 8 is a plan view of another electrical connector of the prior art.

As shown in FIGS. 1-4 and 6, first, second, and third printed circuit board attachment members 18*a*, 18*b*, 18*c*, respectively, are provided on the rear wall 15 of the housing 10. As shown in FIG. 2, the first printed circuit board attachment member 18*a* protrudes rearward from the rear wall 15 and is positioned toward the right. The second printed circuit board attachment member 18*b* protrudes rearward from the right end portion of the rear wall 15. The third printed circuit board attachment member 18*c* protrudes rearward from the left end portion of the rear wall 15. As shown in FIG. 3, a cutout step member 19 for mounting the housing 10 on a printed circuit board PCB (FIG. 6) is formed in a bottom surface of the rear wall 15 of the housing 10. The cutout step member 19 is formed so as to open rearward and downward in the housing 10. The cutout step member 19 has a depth in a vertical direction such that the bottom surface of the printed circuit board PCB (FIG. 6) is in the same plane as a bottom surface of the bottom wall 12 of the housing 10 when the housing 10 is mounted on the printed circuit board PCB (FIG. 6).

The housing 10 contains first and second contacts 20, 21. The first contacts 20 may be, for example, signal contacts. The second contacts 21 may be, for example, power supply contacts. For example, the second contacts 21 may be arranged in four rows in the first connector receiving recess 16*a* and in two rows in the second connector receiving recess 16*b*. The first contacts 20 may be arranged in three rows in the second connector receiving recess 16*b*. The second contacts 21 may be arranged in two rows and the first contacts 20 may be arranged in three rows in the third connector receiving recess 16*c* as well. The first contacts 20 may be arranged in three rows in the fourth connector receiving recess 16*d*. The first contacts 20 may be arranged in three rows in the fifth connector receiving recess 16*e*. The first contacts 20 may be arranged in six rows in the sixth connector receiving recess 16*f*. The first contacts 20 may be arranged in six rows and the second contacts 21 may be arranged in four rows in the seventh connector receiving recess 16*g*.

Figure 4:
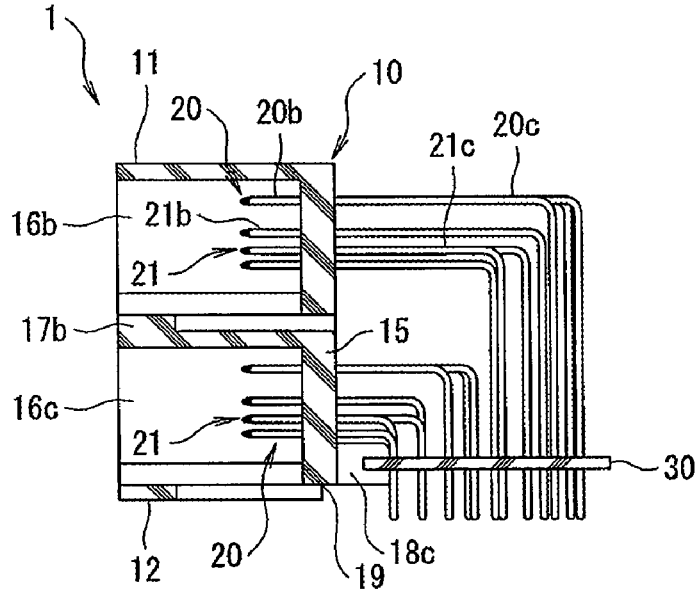
FIG. 4 is a sectional view taken along line 4-4 in FIG. 1.
Figure 5:
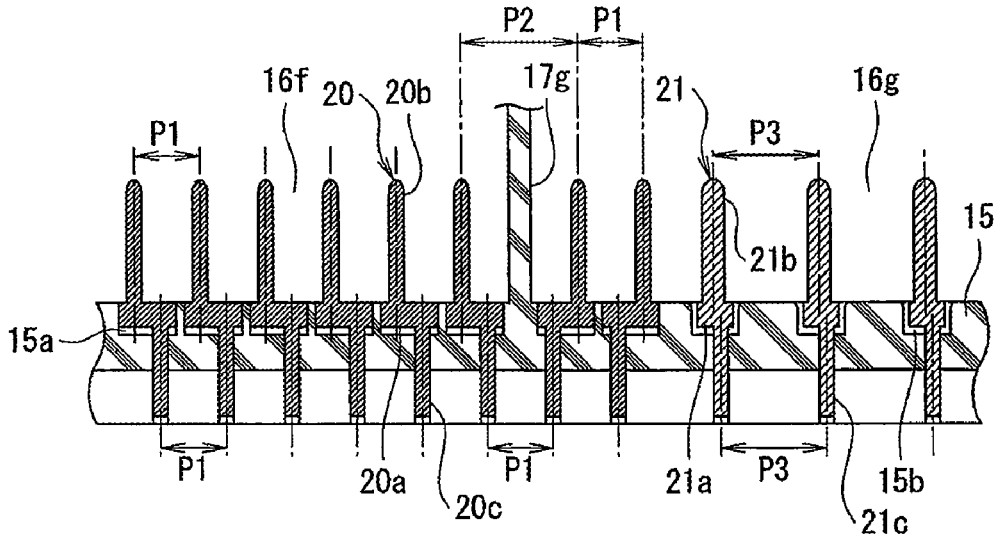
FIG. 5 is an enlarged view of region A in FIG. 3.

As shown in FIGS. 4-5, each of the first contacts 20 comprises a housing securing member 20*a* that is press-fitted to a contact securing opening 15*a* in the rear wall 15 of the housing 10. A contact member 20*b* extends forward from a front end of the housing securing member 20*a*. A circuit board connecting member 20*c* extends rearward from a rear end of the housing securing member 20*a* and is then bent downward to be connected by soldering to the printed circuit board PCB (FIG. 6). The contact members 20*b* of the first contacts 20 have a substantially tab-like shape and extend into interiors of the respective second through seventh connector receiving recesses 16*b*, 16*c*, 16*d*, 16*e*, 16*f*, 16*g* so that the contact members 20*b* are received by and make contact with female type mating contacts (not shown) provided in mating connectors 50 (FIG. 6). As shown in FIG. 5, the first contacts 20 are formed so that center lines of the contact members 20*b* and center lines of the circuit board connecting members 20*c* are offset from each other. Each of the first contact 20 may be formed to have the same shape and may be formed, for example, by stamping and forming a metal plate.

As shown in FIGS. 4-5, each of the second contacts 21 comprises a housing securing member 21*a* that is press-fitted to contact securing openings 15*b* in the rear wall 15 of the housing 10. A contact member 21*b* extends forward from a front end of the housing securing member 21*a*. A circuit board connecting member 21*c* extends rearward from a rear end of the housing securing member 21*a* and is then being bent downward for connection to the printed circuit board PCB (FIG. 6), for example, by soldering. The contact members 21*b* of the second contacts 21 have a substantially tab-like shape that is wider than that of the contact members 20*b* of the first contacts 20. The contact members 21*b* extend into the interiors of the respective first, second, third, and seventh connector receiving recesses 16*a*, 16*b*, 16*c*, 16*g* so that the contact members 21*b* are received by and make contact with the female type mating contacts (not shown) provided in the mating connectors 50 (FIG. 6). As shown in FIG. 5, the second contacts 21 are formed so that center lines of the contact members 21*b* and center lines of the circuit board connecting members 21*c* are offset from each other. Each of the second contacts 21 may be formed to have the same shape and may be formed, for example, by stamping and forming a metal plate.

The first contacts 20 that are disposed in the second through seventh connector receiving recesses 16*b*, 16*c*, 16*d*, 16*e*, 16*f*, 16*g* are arranged so that the circuit board connecting members 20*c* of adjacent first contacts 20 have substantially the same pitch P1, as shown in FIG. 5 (only the signal contacts arranged in the sixth and seventh connector receiving recesses 16*f*, 16*g* are shown in FIG. 5). The first contacts 20 that are disposed in the second, third, and sixth connector receiving recesses 16*b*, 16*c*, 16*f* are arranged so that the contact members 20*b* are positioned on a left side of the respective circuit board connecting member 20*c*. The adjacent contact members 20*b* are arranged to have substantially the same pitch P1 there between. As shown in FIG. 5, the first contacts 20 that are disposed in the fourth, fifth, and seventh connector receiving recesses 16*d*, 16*e*, 16*g* are inverted by substantially 180 degrees. The adjacent contact members 20*b* of the first contacts 20 that are inverted by substantially 180 degrees have the pitch P1. The contact member 20*b* of the leftmost first contact 20 of each row among the first contacts 20 that are inverted by substantially 180 degrees and the contact member 20*b* of the rightmost first contact 20 that is adjacent to this first contact 20 in each row (among the first contacts 20 that are disposed in the second, third, and sixth connector receiving recesses 16*b*, 16*c*, 16*f*) has a pitch P2, which is different from the pitch P1 between the circuit board connecting members 20*c*.

As shown in FIG. 1, the third partition wall 17*c* is disposed between the leftmost first contacts 20 of the substantially 180 degree inverted first contacts 20 arranged in the fourth connector receiving recess 16*d* and the first contacts 20 arranged in the second connector receiving recess 16*b* that are adjacent to the leftmost first contacts 20. The third partition wall 17*c* is further disposed between the leftmost first contacts 20 of the substantially 180 degree inverted first contacts 20 arranged in the fifth connector receiving recess 16*e* and the first contacts 20 arranged in the third connector receiving recess 16*c* that are adjacent to the leftmost first contacts 20. As shown in FIG. 5, the seventh partition wall 17*g* is disposed between the leftmost first contacts 20 of the substantially 180 degree inverted first contacts 20 arranged in the seventh connector receiving recess 16*g* and the first contacts 20 that are arranged in the sixth connector receiving recess 16*f* that are adjacent to the leftmost first contacts 20.

As shown in FIG. 5, the second contacts 21 that are disposed in the first, second, third, and seventh connector receiving recesses 16*a*, 16*b*, 16*c*, 16*g* are arranged so that the circuit board connecting members 21*c* of adjacent second contacts 21 have substantially the same pitch P3 (only the second contacts 21 arranged in the seventh connector receiving recess 16*g* are shown in FIG. 5). The second contacts 21 are arranged so that the contact members 21*b* are positioned on the left sides of the circuit board connecting members 21*c*. The adjacent contact members 21*b* are arranged to have substantially the same pitch P3 there between.

As shown in FIG. 3, a tine plate 30 for aligning the circuit board connecting members 20*c* of the first contacts 20 and the circuit board connecting members 21*c* of the second contacts 21 is attached above the bottom surface of the bottom wall 12 of the housing 10. The height of the housing 10 can be reduced by the thickness of the printed circuit board PCB (FIG. 6) by attaching the tine plate 30 above the bottom surface of the bottom wall 12 of the housing 10 and making the bottom surface of the printed circuit board PCB (FIG. 6) in the same plane as the bottom surface of the bottom wall 12 of the housing 10. A plurality of alignment openings 31, 32 for insertion and alignment of the circuit board connecting members 20*c*, 21*c* of the first and second contacts 20, 21, respectively, is formed in the tine plate 30. A first cutout 30*a* with which the first printed circuit board attachment member 18*a* engages, a second cutout 30*b* with which the second printed circuit board attachment member 18*b* engages, and a third cutout 30*c* with which the third printed circuit board attachment member 18*c* engages are formed in the tine plate 30. Movement of the tine plate 30 in the left-right direction is thereby restricted by the first, second, and third printed circuit board attachment members 18*a*, 18*b*, 18*c* and cutouts 30*a*, 30*b*, 30*c* working together.

As shown in FIG. 6, mating housings 51 of the mating connectors 50 are received in the first through seventh connector receiving recesses 16*a*, 16*b*, 16*c*, 16*d*, 16*e*, 16*f*, 16*g* of the electrical connector 1 during mating. The mating contacts (not shown), which are connected to electrical wires W, are accommodated in the mating housings 51 of the mating connectors 50. When the electrical connector 1 and the mating connectors 50 are mated, the mating contacts (not shown) come into contact with the first and second contacts 20, 21 of the housing 10 to electrically connect the electrical wires W with the printed circuit board PCB.

Due to the arrangement of the first contacts 20 in the electrical connector 1, pitch conversion can be performed by using only one type of the first contacts 20. Additionally, pitch conversion does not need to be performed for the second contacts 21. Consequently, it is not necessary to use a wiring board or the like in addition to the first contacts 20 for the purpose of pitch conversion. As a result, the cost of the electrical connector 1 is low, and the electrical connector 1 can be easily assembled. Furthermore, since there is no need to use contacts having a large variety of shapes for the purpose of pitch conversion, it is likewise unnecessary to manufacture many contact molds according to the pitch conversion modes. Problems associated with press-fitting the first and second contacts 20, 21 to the housing 10 are also eliminated.

In addition, due to the arrangement of the first through seventh partition walls 17*a*, 17*b*, 17*c*, 17*d*, 17*e*, 17*f*, 17*g*, it is possible to form second through fifth connector receiving recesses 16*b*, 16*c*, 16*d*, 16*e* that can receive separate mating connectors 50 on either side of the third partition wall 17*c*. Furthermore, it is possible to form sixth through seventh connector receiving recesses 16*f*, 16*g* that can receive separate mating connectors 50 on either side of the seventh partition wall 17*g*. Consequently, even in cases where the electrical connector 1 is a multi-pole connector provided with numerous first and second contacts 20, 21, separate mating connectors 50 can easily be mated with the electrical connector 1 without installing any power step-up mechanism or the like.

The foregoing illustrates some of the possibilities for practicing the invention. Many other embodiments are possible within the scope and spirit of the invention. For example, the substantially 180 degree inverted first contacts 20 are not limited to the first contacts 20 that are disposed in the fourth, fifth, and seventh connector receiving recesses 16*d*, 16*e*, 16*g*, as long as the first contacts 20 are inverted substantially 180 degrees and the pitch between the contact members 20*b* of the first contacts 20 and the contact members 20*b* of the first contacts 20 that are adjacent to these first contacts 20 is different from the pitch between the circuit board connecting members 20*c*. It is also possible to perform pitch conversion by inverting a plurality of the second contacts 21 substantially 180 degrees. Moreover, the connector receiving recesses are not limited to the first through seventh connector receiving recesses 16*a*, 16*b*, 16*c*, 16*d*, 16*e*, 16*f*, 16*g* and can be altered as appropriate. In addition, the number of the first and second contacts 20, 21 arranged in the first through seventh connector receiving recesses 16*a*, 16*b*, 16*c*, 16*d*, 16*e*, 16*f*, 16*g* may be varied. It is, therefore, intended that the foregoing description be regarded as illustrative rather than limiting, and that the scope of the invention is given by the appended claims together with their full range of equivalents.

What is claimed is:

1. An electrical connector, comprising:

an insulating housing;

first contacts secured to the housing, each of the first contacts having the same shape and including a housing securing member, a contact member extending from a first end of the housing securing member, and a circuit board connecting member extending from a second end of the housing securing member that is offset from the contact member; and the first contacts being secured to the insulating housing in at least one row such that a first plurality of the first contacts is inverted by 180 degrees with respect to a second plurality of the first contacts in the at least one row, the circuit board connecting members of the first contacts in the first and second pluralities having the same pitch along the at least one row, and the contact members of the first contacts of the first plurality facing the contact members of the first contacts of the second plurality having a different pitch than the pitch of the circuit board connecting members along the at least one row.

2. The electrical connector according to claim 1, wherein a partition wall extends between the first and second pluralities of the first contacts.

3. The electrical connector according to claim 1, wherein a center line of the contact member is offset from a center line of the circuit board connecting member.

4. The electrical connector according to claim 1, wherein the first contacts are formed from a metal plate.

5. The electrical connector according to claim 1, wherein the housing connecting member is press-fitted into the housing.

6. The electrical connector according to claim 1, further comprising second contacts.

7. The electrical connector according to claim 6, wherein the first contacts are signal contacts and the second contacts are power supply contacts.

8. The electrical connector according to claim 6, wherein the second contacts have contact members, the contacts members of adjacent second contacts being arranged at a pitch different from the pitch of the first contacts.

9. An electrical connector, comprising:

an insulating housing having at least one row of first contacts, the at least one row of first contacts extending over a plurality of connector receiving recesses that each receive a separate mating connector, each of the first contacts including a housing securing member, a contact member extending from a first end of the housing securing member, and a circuit board connecting member extending from a second end of the housing securing member that is offset from the contact member; and the first contacts arranged in adjacent connector receiving recesses being inverted by 180 degrees with respect to each other such that the circuit board connecting members have a different pitch than the contact members between the adjacent connector receiving recesses in a direction of length of the insulating housing.

10. The electrical connector according to claim 9, wherein a partition wall extends between the first contacts in the adjacent connector receiving recesses.

11. The electrical connector according to claim 9, wherein each of the first contacts has the same shape.

12. The electrical connector according to claim 9, wherein a center line of the contact member is offset from a center line of the circuit board connecting member.

13. The electrical connector according to claim 9, wherein the first contacts are formed from a metal plate.

14. The electrical connector according to claim 9, wherein the housing connecting member is press-fitted into the housing.

15. The electrical connector according to claim 9, wherein the circuit board connecting members and the contact members within each of the connector receiving recesses of the insulating housing are arranged at the same pitch.

16. The electrical connector according to claim 9, wherein the pitch of the circuit board connecting members between the adjacent connector receiving recesses is the same as the pitch of the circuit board connecting members and the contact members within each of the connector receiving recesses of the insulating housing.

17. The electrical connector according to claim 9, further comprising second contacts arranged adjacent to the first contacts in at least one of the connector receiving recesses.

18. The electrical connector according to claim 17, wherein the first contacts are signal contacts and the second contacts are power supply contacts.

19. The electrical connector according to claim 17, wherein each of the second contacts includes a housing securing member, a contact member extending from a first end of the housing securing member, and a circuit board connecting member extending from a second end of the housing securing member that is offset from the contact member, the contact members of the second contacts being arranged at a pitch different than the pitch of the contact members of the first contacts.

* * * * *